US005527037A

United States Patent [19]

Matsumoto

[11] Patent Number: 5,527,037

[45] Date of Patent: Jun. 18, 1996

[54] GOLF TRAINING DEVICE

[76] Inventor: Robert Matsumoto, 226 N. Niagara St., Burbank, Calif. 91505

[21] Appl. No.: 319,663

[22] Filed: Oct. 7, 1994

[51] Int. Cl.[6] ..... A63B 69/36

[52] U.S. Cl. ..... 473/218; 473/261; 473/272

[58] Field of Search ..... 273/187 R, 186.1, 273/187.1, 186.2, 186.3; 434/252

[56] References Cited

U.S. PATENT DOCUMENTS

| | | | |
|---|---|---|---|
| 1,517,555 | 12/1924 | Graham | 273/187 R |
| 2,169,407 | 8/1939 | Crowley | 273/187 R |
| 3,658,344 | 4/1972 | Kimble | 273/187 R |

*Primary Examiner*—George J. Marlo
*Attorney, Agent, or Firm*—George J. Netter

[57] ABSTRACT

A golf training for resting receipt on a ground plane in use, comprising:

an elongated first member having an end directed generally along a direction it is desired to hit a ball with a golf club, said member including a straight line edge with adjacent measuring marks and along which a user's feet are located;

a second member pivotally and slidably interconnected with the first member by threaded means to extend transversely away from said first member during use, said second member having first and second parts which respectively extend away from opposite sides of the first member;

a third member removably secured to an end portion of the second member by threaded means and having an edge that is continuously convexly curved away from the first member, said curved edge providing a clubhead guide to following during the takeway, downswing and follow through of a golf swing said third member further including a strip extending along and immediately adjacent to the curved edge which is of a color that differs from the color of that part of the third member next adjacent thereby visually emphasizing the clubhead guide path;

and a pin on the third member has an end portion which is snugly received within an opening in the second member to fix the relative orientation of the said members during use at a predetermined angle of substantially 90 degree.

3 Claims, 5 Drawing Sheets

GOLF TRAINING DEVICE

BACKGROUND OF THE INVENTION

1. Field of the Invention

The present invention relates generally to a training device for the game of golf, and, more particularly, to such a device for instructing and aiding a golfer to assume proper stance and alignment to move a golf club along a desired path to produce a satisfactory striking of the ball with the club head.

2. Description of Related Art

A difficult matter, especially for new golfers, is to position the body with respect to a fairway or green so that when a golf ball is struck it will go toward the target. This body positioning is generally referred to as "alignment" and is affected by many factors, a major source of error being the fact a golfer must face generally at 90° to the direction it is desired to hit the ball. Also, many individuals do not normally stand with their shoulders exactly parallel to a line drawn through the feet either "opening" the body toward the target or "closing" it so that the body faces to right of the target.

A further difficult thing for a new golfer is to know exactly what path the club head should take in order to strike a ball in a reasonably satisfactory manner. This difficulty resides in, among other things, the inability of the golfer to know precisely what path the end of the golf club takes, especially during the early part of the swing in order to obtain good results. That is, the golfer frequently believes that he is moving along a certain path whereas, in fact, he may be moving along a different path, either taking the club outside or inside the desired line for achieving a satisfactory path to strike the ball. It is a commonly heard statement in the teaching of golf to take the club head along the path directly away from the ball to the target for a short distance and then move inside closer to the body to the top. Also, immediately after hitting the ball it is usually recommended that the clubhead continue on a path that curves back slightly toward the body until it finishes with the hands high. However, as a practical matter, most golfers have found that the golf swing is a difficult thing to accomplish and that frequent practice is needed to keep the swing in tune.

SUMMARY OF THE INVENTION

It is therefore a primary aim and object of the present invention to provide a device for aiding the golfer in aligning the body with respect to the path of desired ball flight and in taking the club back away from the ball on a path to the top of the swing, then, as well, provides a visible path to the golfer of the down swing back and through the ball to complete a satisfactory striking of the ball.

In accordance with the present invention, there is provided a device which has three major parts that interact with one another to provide a golf swing path and stance setup for a golfer which is adapted for being positioned on a ground plane (e.g., ground surface, driving range mat). A first elongated member is for use in locating the feet with respect to the ball and the line to the target. A second generally elongated member extends in use from the feet of the individual golfer forwardly to just short of where the ball is to be located. More particularly, the second plate member is secured by a rotatably adjustable means to the first plate member and typically arranged at 90° to the first plate member although adjustable to other angular relations. The first plate member serves as a location means for the toes of the golfer along a line that leads toward the target (e.g., green or fairway). A rotational adjustment provides for varying the position of the feet with respect to the ball in order to produce some desired particular angular relationship, such as using a "closed" stance (hook stance for right handed player), where the right foot is drawn back from the line directly to a target, or for an "open" stance where the left foot is drawn back somewhat from the line leading to the target and tends to produce a fade or slice.

A third member is affixed to the second member at a point several inches from where the ball is to be positioned. In particular, the third member is interconnected intermediate its ends to the second plate member with a first straight portion which extends directly toward the target and a second portion which extends away from the target. This second portion extends for a relatively short distance away from the second plate member at substantially 90° and then continues on an arcing path moving "inside" an imaginary straight target line and toward the user.

In use, the assembled three members are located on a suitable ground plane such as a room floor, the mat at a driving range, or the ground. With the first member being arranged at a suitable distance so when the golfer's toes are aligned with the outer edge of the first member, the golf club head will now extend comfortably from the user to the ball. It is contemplated that the ball will be located just beyond the outer edge of the third member. With the first member adjusted and arranged at, say, 90° to the second member, the golfer will then take the club and move the club head along and over the third member curved portion extending to the right (in the case of a right-hand player). If this path is followed back to the top of the swing and then again downwardly through the ball, the golfer will have made a reasonably satisfactory take-away and return of the club bringing him back with the club face substantially square to the ball which is advisable for producing a satisfactory normally-directed movement of the ball.

Where the golfer is left handed, the third plate is so interconnected with the first plate that it can be reversed enabling a left handed golfer to move away from the left side of the first member with a left handed club.

According to a further version of the invention, the third member has its outer edge farthest from the user formed into a continuous curve. More particularly, the third member curve has its maximum extension at the joinder point (approximately the midpoint) with the second plate from which the curve slopes back toward the user as you move away from the joinder point in both directions. In use, the clubhead is moved back along an inside curved path during takeway and coming down onto the ball. After the ball is struck the user then is reminded to move the clubhead once again along an inwardly directed curved path as the swing is completed with the hands above the left shoulder.

DESCRIPTION OF A PREFERRED EMBODIMENT

Figure 1:
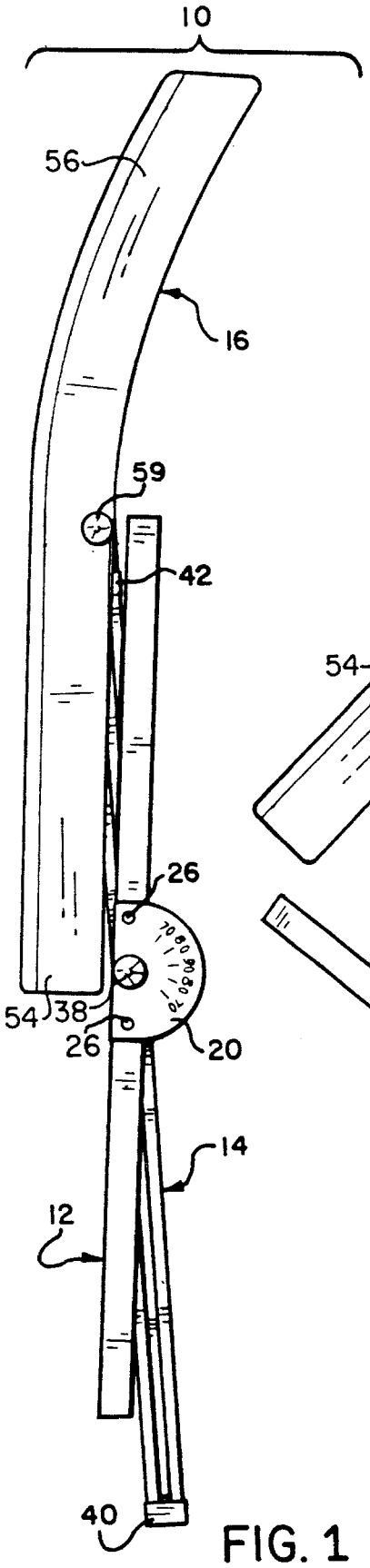
FIG. 1 is an elevational view of the invention shown folded up for storage or carrying.
Figure 2:
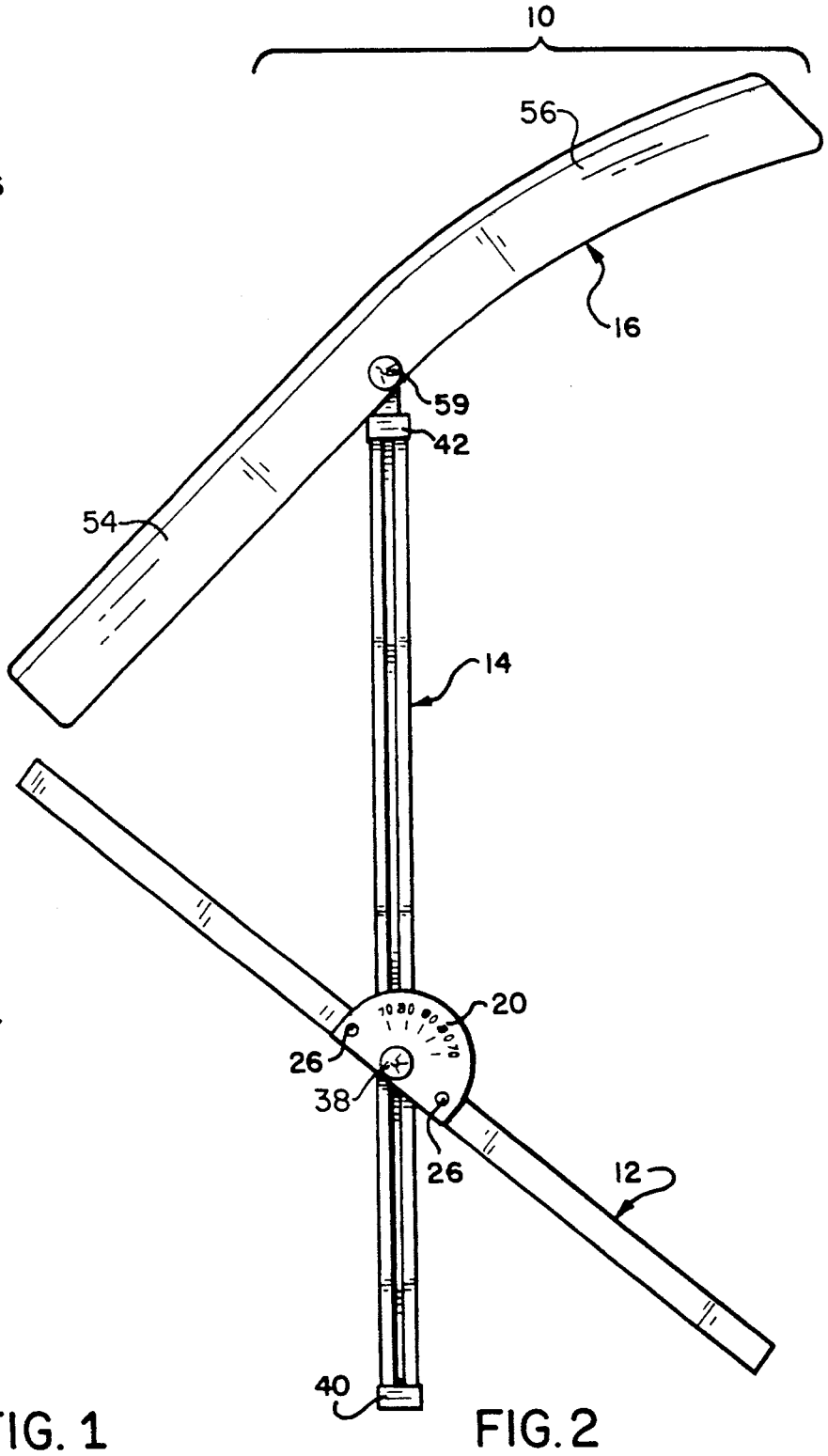
FIG. 2 is an elevational view showing the device partially unfolded.
Figure 3:
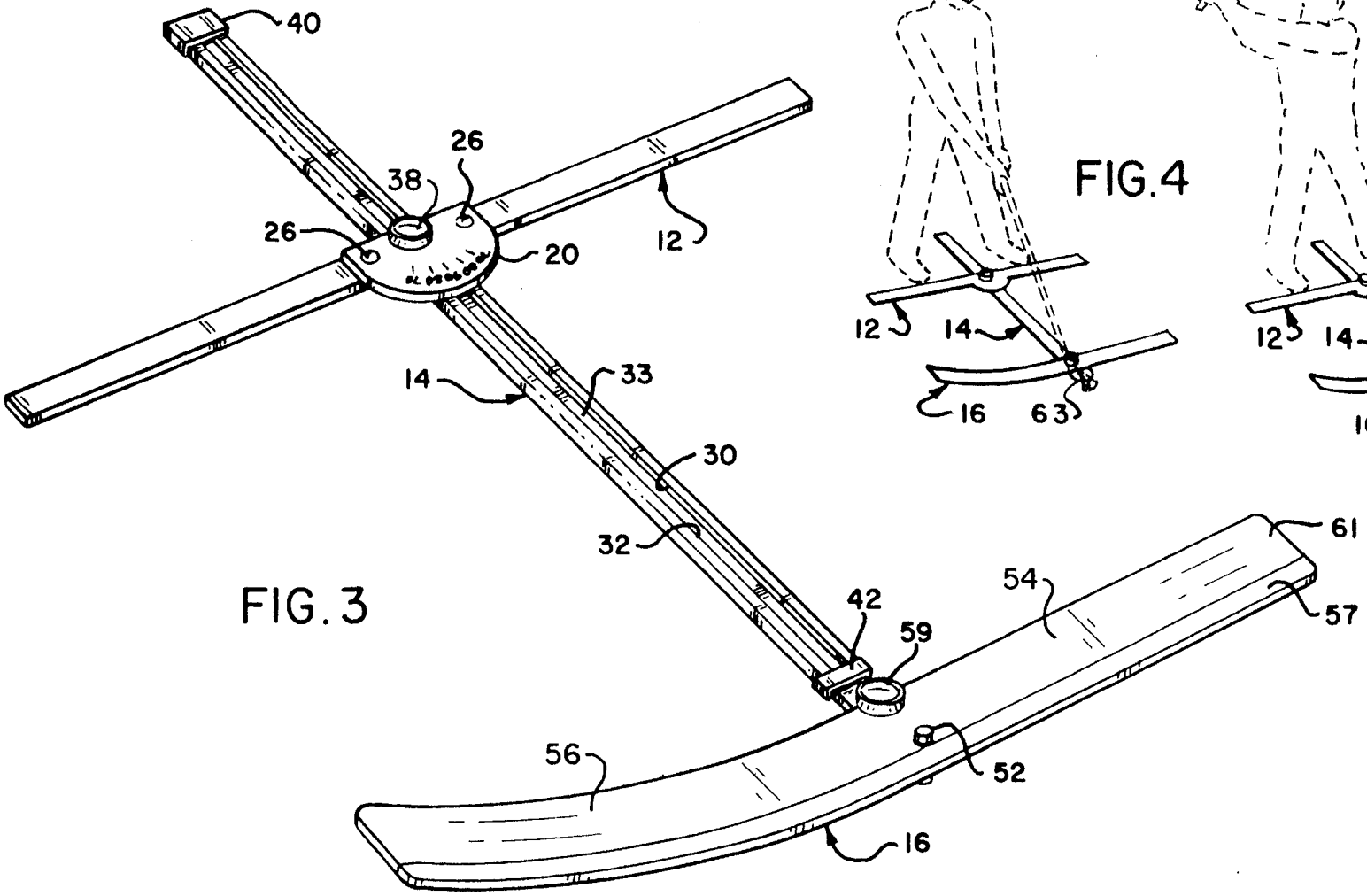
FIG. 3 depicts the invention unfolded for use.

Turning now to the drawings and particularly FIGS. 1–3, the golf swing trainer of the present invention identified generally as 10 is seen to include in its major parts three separate members 12, 14 and 16 which are adjustably interrelated to one another for arranging into either a folded-up or a put-away condition shown in FIG. 1, folded out to an intermediate position (FIG. 2), and extended to a use condition (FIG. 3). As will be more particularly described later, the device of this invention is placed on a ground plane and serves to aid a golfer to properly position his feet attendant hitting a golf ball along a desired target direction and provide a visual path along which the club head is to be moved for the production of a satisfactory swing.

The member 12 consists of an elongated bar of rectangular cross-section having an opening 18 substantially centrally located between the bar opposite ends via which, in a way that will be more particularly described, serves as a pivot point about the member 14. An angular position plate 20 has a straight line side 22 for arrangement along an edge of the member 12 and face generally toward the feet of the user during use. A forward facing front edge 24 of the plate is curved. The plate 20 is secured to the member 12 by threaded means 26 and includes a central opening 28 which is in alignment with the opening 18. A plurality of angular indicia 29 are provided on an upper or outer surface of the plate for use that will be described.

The member 14 is elongated and preferably constructed from a flat piece of rectangularly shaped metal skelp that has its two opposite side edge portions folded partially back toward each other with the skelp edges facing each other on the same side of the member. The two edges which face one another identified as 30 and 32 are spaced apart to define an access slot 33 therebetween. A slide 34 is located within the internal Space formed by the folded edge portions and, as the name implies, is so dimensioned as to slide along the internal space of the member 14.

A threaded pivot bolt 36 is affixed to the slide 34 in conventional manner and extends outwardly through the access slot 33 between edges 30 and 32. The bolt 36 is so dimensioned as to enable sliding passage through the opening 18 in member 12 as well as through the opening 28 in plate 20. A knob-like nut 38 is threaded onto the outer end of the pivot bolt and can be tightened by hand in order to adjustably clamp the members 12 and 14 at any desired angular relationship. The angular indicia on the outer surface of the plate 20 serves to aid the user of the equipment in selectively positioning the members 12 and 14 at any predetermined angular relationship, although as will be noted in the usual case it will be 90°.

A cap 40 is secured onto an outer end of the member 14 and is secured to the member 14 by crimping, for example. At the opposite end of the member 14, a band or loop 42 is slipped over the end and crimped in place in order to maintain the integrity of that member end.

An extension arm 44 is a generally rectangular plate or bar having one end which can be received through the loop 42 and into the internal space of member 14 for securement to the member 14 by threaded means 46. The outer end portion of the arm 44 includes a guide opening 48 adjacent the outer extremity, and a second opening 50 spaced rearwardly along the arm from the first opening 48, which includes a bolt 52 extending through the opening for a use to be described.

The member 16 has a generally rectangular end portion 54 which is unitary with a somewhat continuously curved opposite end portion 56. At substantially the juncture between the end portions 54 and 56 there is provided an opening 58 that is received onto bolt 52 of the extension arm 44 with securement being achieved by a finger operated nut 59 to the bolt end. Spaced transversely of the member 16 from opening 58, a pin 60 extends into the opening 48 at the same time opening 58 is received on bolt 52. On being so assembled, the straight end portion 54 extends at 90° from member 14 to the left, and the curved end portion 56 extends to the right (for a right hand golfer) with the latter end portion curving back toward the member 12.

The outer major surfaces of member 16 are formed into two differently colored ribbons 57 and 61, for example, extending generally parallel to each other the full length of the member. Although other color selections may be found advantageous, it is preferred that the ribbon 57 which is farthest from the user be white and the other larger ribbon 61 black. It is the outermost ribbon 57 of portion 58 that provides the main visual guide to be tracked by the clubhead as it moves away from the ball to the top of the swing.

Figure 4:
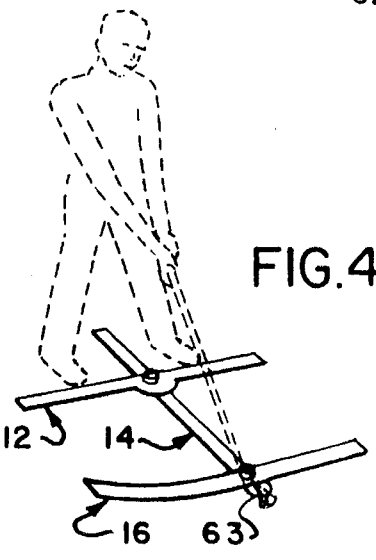
Figure 6:
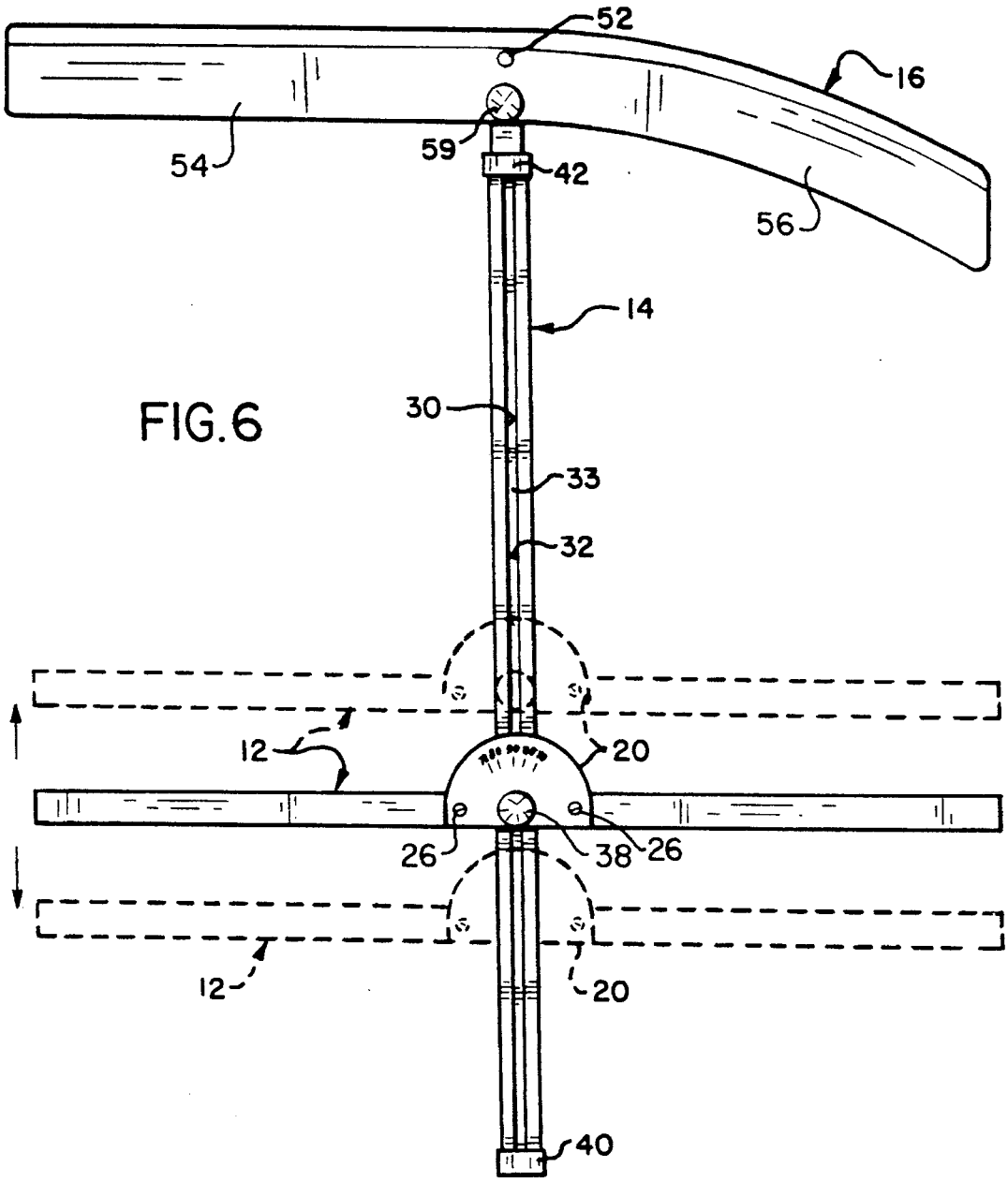
FIG. 6 shows several positions of adjustment for the device.
Figure 7:
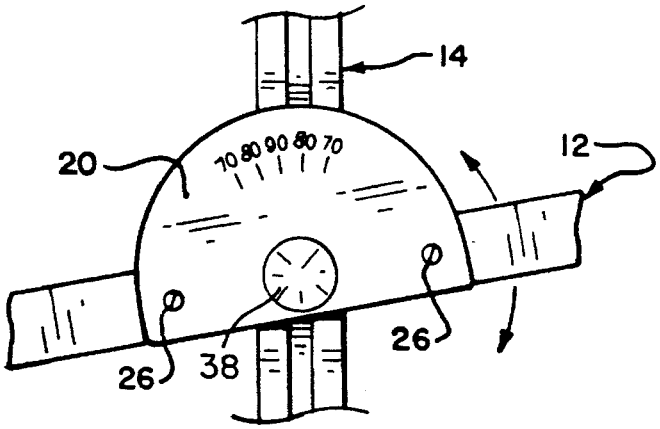
FIG. 7 is an enlarged view of the angle plate.
Figure 8:
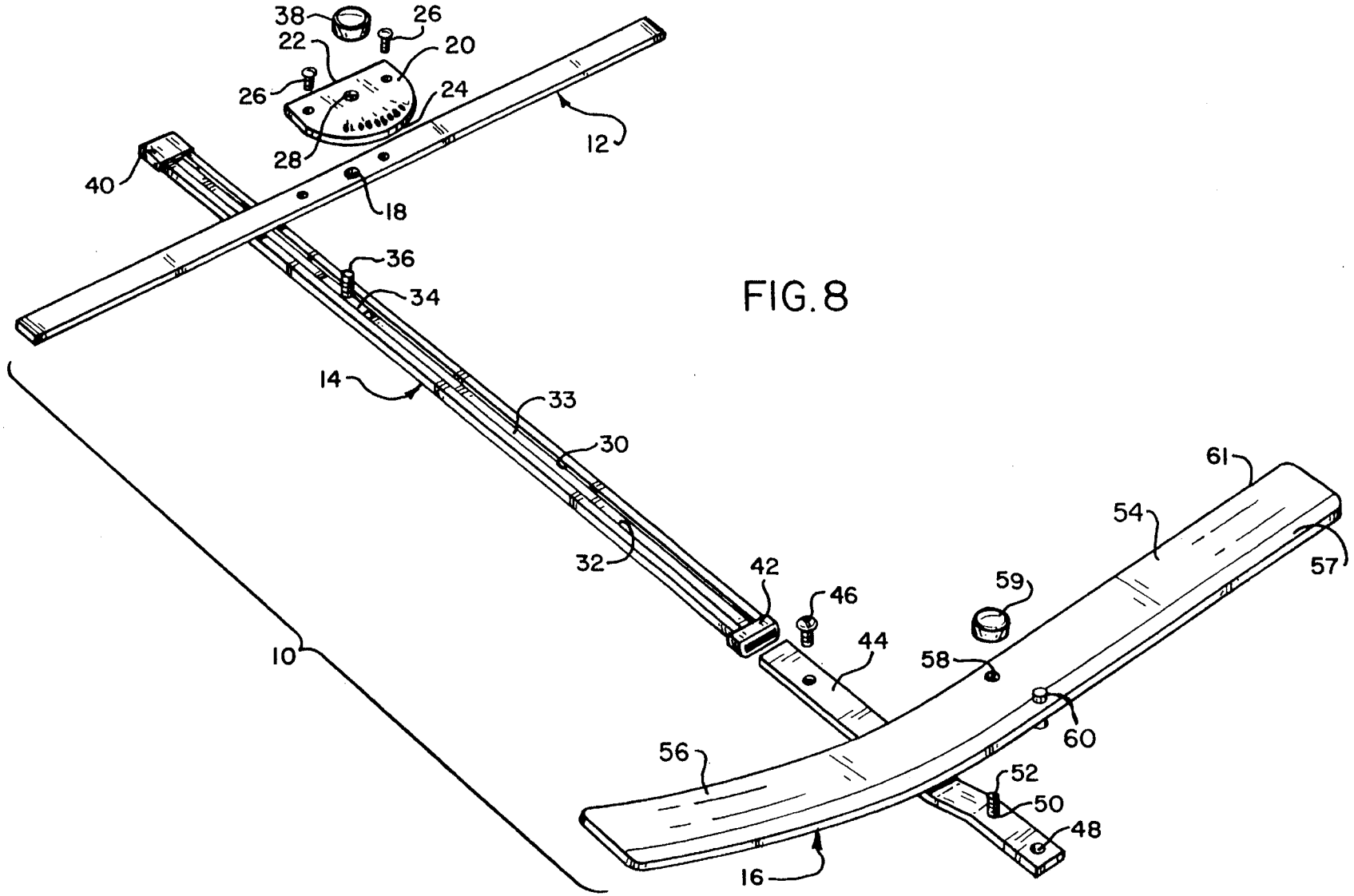
FIG. 8 is an exploded view of the invention.

For description of use by a righthand individual, assume the member 14 is arranged and secured at 90° to member 12 and member 16 affixed to the extension arm 44 as already described (FIG. 4). The entire assembly is then located on a suitable ground plane (e.g., floor, mat at driving range) with the straight end portion 54 pointing generally toward a suitable target. The proper stance for the individual can be adjusted as needed by loosening nut 38 and shifting member 12 accordingly (FIG. 6). With the straight portion 54 pointing directly to the target and member 12 at 90° to member 14, on the user placing his toes against the edge of member 12 he will have a "square" alignment.

Figure 5:
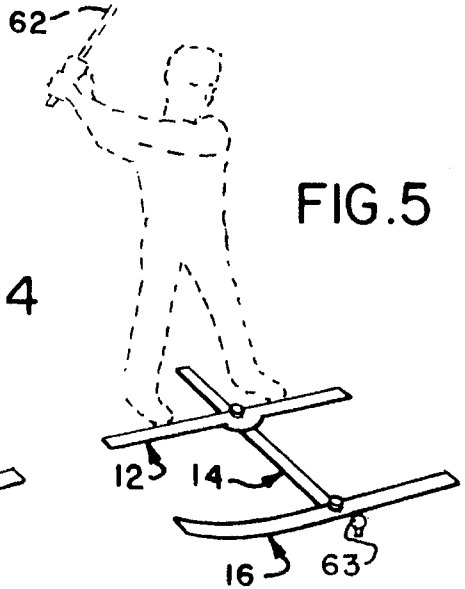
FIGS. 4 and 5 are schematic representations of the invention during use.

The ball is then conveniently located just beyond the outer edge of member 16 at 63, for example. With the toes positioned along the edge of member 12, the rear edge of club 62 is moved back following the curved end portion as a guide for the club head (FIG. 4) until the club is at the top of the swing (FIG. 5), after which the club is brought back down very much the same path to strike the ball. At both take away from the ball and returning to strike the ball ("hitting zone") a proper path for the club is provided to the user for achieving a satisfactory striking of the ball.

For a lefthanded golfer, the member 16 is merely assembled with the straight end portion directed to the right of member 14 and the curved portion to the left.

There is provided in accordance with the present invention a device for enabling a golfer to set up to a ball in a predetermined aligned manner. Also, the device provides a visible desired path for the club head to move along and over in making a satisfactory swing. By tracking the swing in this manner, the golfer automatically receives the feeling of a proper swing.

If it is decided to adopt a hook or slice stance, this may be easily accomplished by either withdrawing the right or left foot, as the case may be, from the edge of member 12 while leaving the other foot in contact with the edge.

Alternatively, the nut 38 may be loosened and rotated in the proper direction so that on retightening the feet on touching the edge of member 12 are appropriately aligned to produce a hook or slice, as desired.

Figures 9, 10:
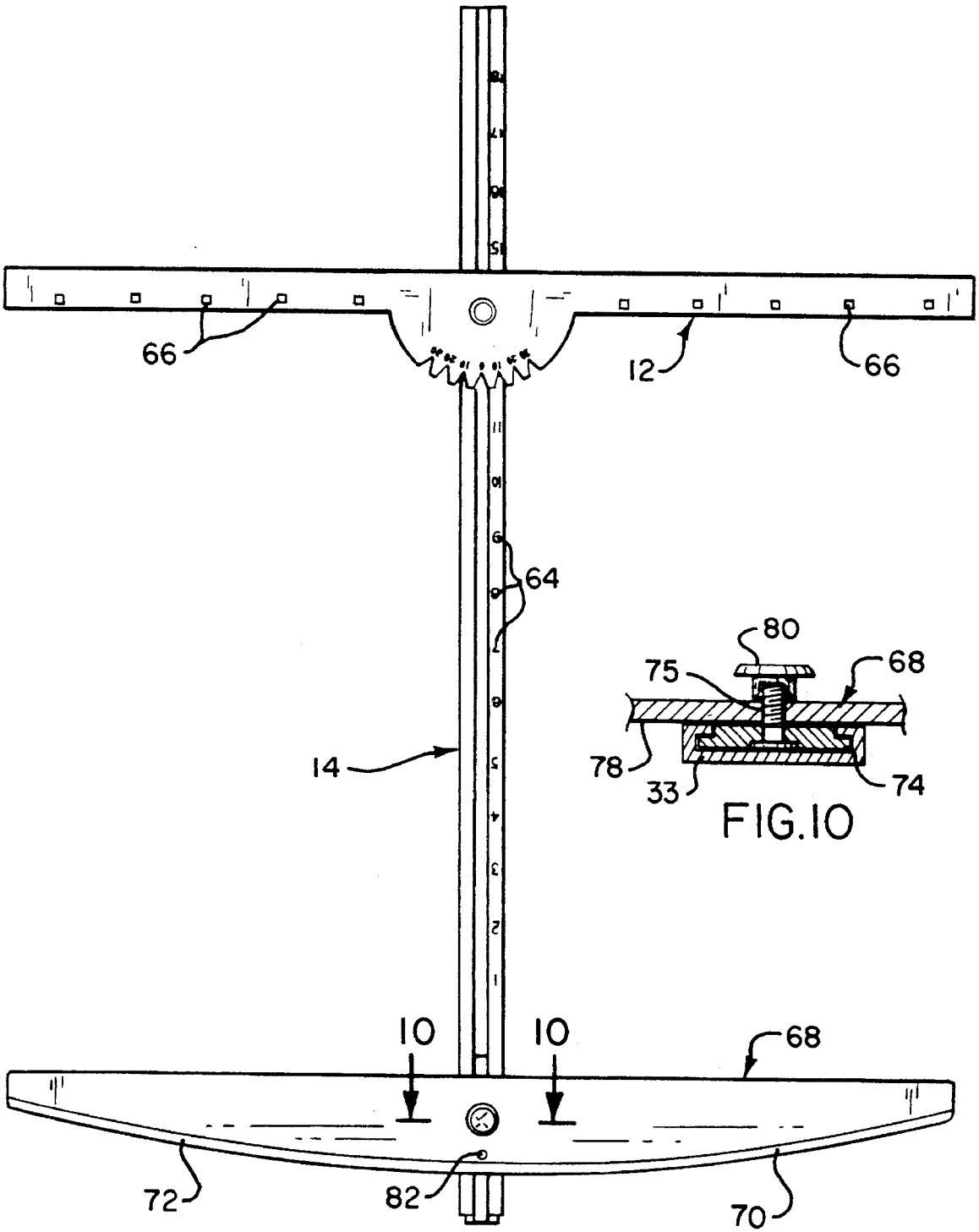
FIG. 9 is an elevational view of an alternative embodiment of the invention.
FIG. 10 is a sectional view taken along the line 10—10 of FIG. 9.

As can be best seen in FIG. 9, an alternative embodiment of the invention is shown in which the member 14 includes on its upwardly facing surface (i.e., the one seen by the user) a set of numbered measurement markings 64 enabling the user of the device to precisely locate the desired spacing of his feet from the ball. More precisely, at first the user will position the member 12 at several different spacings from the member 16 (and thus the ball) until the user is comfortable. Then, the precise spacing can be read off the numbered measurement markings 64 for use during actual play on a course and for use during later practice sessions. Also, by having the measurement markings extending below or beyond the member 12 the user is able to measure the amount of withdrawal of one of his feet from the square position when it is desired to adopt a hook or slice stance. Again, this foot position measurement can be retained for use during actual course play.

Still referring to FIG. 9, the evenly spaced markings 66 enable precise positioning of the feet with respect to the ball by measuring along a line parallel to the target direction. For example, a different stance is frequently used for the different clubs, and it is advisable to determine precisely at what stance best results are obtained with each of the various clubs.

It is to be noticed that in FIG. 9 the member 16 (FIG. 1) is replaced with a member 68 having its outermost edge 70 formed into a continuous curve with the farthest point from member 12 lying along the longitudinal axis of member 14. More particularly, the member 68 can be considered as constructed of two identically shaped curved portions 56 extending to the left and right from the juncture point with member 14 and unitary with one another. A strip 72 of different color or distinct visual difference from the remainder of the member extends along the entire curved edge, and it is this strip 72 that the user attempts to move the rear edge of the club along both for the downswing and followthrough. In explanation, it has been found that for most standard golf shots it is desirable to curve back toward the user a certain amount during takeaway, and then again after striking the ball the club should once again curve back toward the user as the club is raised to the finish of the swing.

It will be recalled that in the first described embodiment, when the user changes from a right-handed person to a left-handed person the member 16 has to be disassembled from the remainder of the device, turned to point oppositely, and then resecured in the device. This is not necessary in the FIG. 9 device where the member 68 is used since it is symmetrically curved and will accommodate either a right- or left-handed person without change.

FIG. 10 shows in cross-section the specific manner of securing the member 68 to the member 14. In particular, an anchor block 74 is fittingly received within the access slot 33 and secured thereto by a threaded means 75. The outermost surface 76 of the block is coextensive with the outer surfaces of member 14 edges 30 and 32 enabling even receipt of the smooth back surface 78 of member 68. Attachment of the member 68 to member 14 is similar to the manner used for the first described embodiment using a knob 80 threaded onto the end of threaded means 75 on having a pin 82 similar to pin 60 received within an opening in block 74 identical to opening 48 in arm 44 for insuring member 68 extends at equal angles to member 14.

Although the invention has been described in connection with a preferred embodiment, it is to be understood that one skilled in the art may make changes which come within the spirit of the invention as described and within the ambit of the appended claims.

What is claimed is:

1. A golf training device for resting receipt on a ground plane in use, comprising:

an elongated first member having an end directed generally along a direction it is desired to hit a ball with a golf club, said member including a straight line edge with adjacent measuring marks and along which a user's feet are located;

a second member pivotally and slidably interconnected with the first member to extend transversely away from said first member during use, said second member having first and second parts which respectively extend away from opposite sides of the first member;

a third member removably secured to an end portion of the second member and having an edge that is continuously convexly curved away from the first member, said curved edge providing a clubhead guide to following during the takeway, downswing and follow through of a golf swing, said third member further including a strip extending along and immediately adjacent to the curved edge which is of a color that differs from the color of that part of the third member next adjacent thereby visually emphasizing the clubhead guide path;

said first member is removably and pivotally secured to the second member by a first threaded means extending through openings in said first and second members, and a nut received on the end of the threaded means; the second and third members being removably and pivotally secured together by a second threaded means that extends through openings in the said second and third members, and a second nut received on the end of the second threaded means; and a pin on the third member has an end portion which is snugly received within an opening in the second member to fix the relative orientation of the said members during use at a predetermined angle of substantially 90 degrees; and said first and third members are releasable from and pivotable with respect to the second member so as to be able to be extended along the said second member for common storage within a golf bag.

2. A golf training device as in claim 1, in which a set of equispaced measurement indicia extend along a surface of both the first and second parts of the second member.

3. A golf training device as in claim 1, in which the first and third members are each constructed of flat metal of substantially uniform thickness.

* * * * *